United States Patent [19]

Specktor

[11] 4,296,624

[45] Oct. 27, 1981

[54] ACCESSORY FOR AN APPARATUS FOR REPAIRING AND STRAIGHTENING

[76] Inventor: Gerald A. Specktor, 409 Cleveland Ave. South, St. Paul, Minn. 55105

[21] Appl. No.: 1,082

[22] Filed: Jan. 5, 1979

Related U.S. Application Data

[60] Division of Ser. No. 722,825, Sep. 13, 1976, Pat. No. 4,138,877, which is a continuation of Ser. No. 550,378, Feb. 18, 1975, abandoned.

[51] Int. Cl.[3] ..... B21D 1/12; B21D 1/14

[52] U.S. Cl. ..... 72/308; 72/705

[58] Field of Search ..... 72/705, 308, 446, 447; 403/18, 252, 326, 347; 105/464, 465, 485

[56] References Cited

U.S. PATENT DOCUMENTS

| | | | |
|---|---|---|---|
| 1,676,263 | 7/1928 | Hawkins | 72/705 X |
| 2,674,774 | 4/1954 | Modrey | 403/18 X |
| 3,070,042 | 12/1962 | Dunlap | 24/201 A UX |
| 3,108,629 | 10/1963 | Jenkins | 72/705 X |
| 3,131,747 | 5/1964 | Junkins | 72/705 X |
| 3,149,660 | 9/1964 | Smith | 72/705 X |
| 3,252,681 | 5/1966 | Watts | 105/485 |
| 3,377,834 | 4/1968 | Latuff et al. | 72/705 X |
| 3,689,030 | 9/1972 | Backus | 72/705 X |
| 3,888,100 | 6/1975 | Chisum | 72/705 X |

FOREIGN PATENT DOCUMENTS

| | | | |
|---|---|---|---|
| 255547 | 4/1964 | Australia | 72/705 |
| 2324947 | 12/1973 | Fed. Rep. of Germany | 403/252 |
| 37143 | 7/1975 | Japan | 72/705 |

*Primary Examiner*—Lowell A. Larson
*Attorney, Agent, or Firm*—Wicks & Nemer

[57] ABSTRACT

Accessory is disclosed, in its preferred form, for use in conjunction with an apparatus for repairing and straightening vehicles having a support surface for supporting vehicles thereon. The support surface includes an array of regularly shaped apertures which extend vertically therethrough. A unibody clamp is disclosed including adjustable jaws for removably gripping the pinch weld of a unibody frame. A first connector member is further provided on the clamp for allowing the use of a down pull member including a chain directed to the clamp by a rotatably mounted pulley. The down pull member is removably attached to the support surface by an attachment member which extends into a selected support surface aperture and allows self-alignment thereof in the support surface.

10 Claims, 6 Drawing Figures

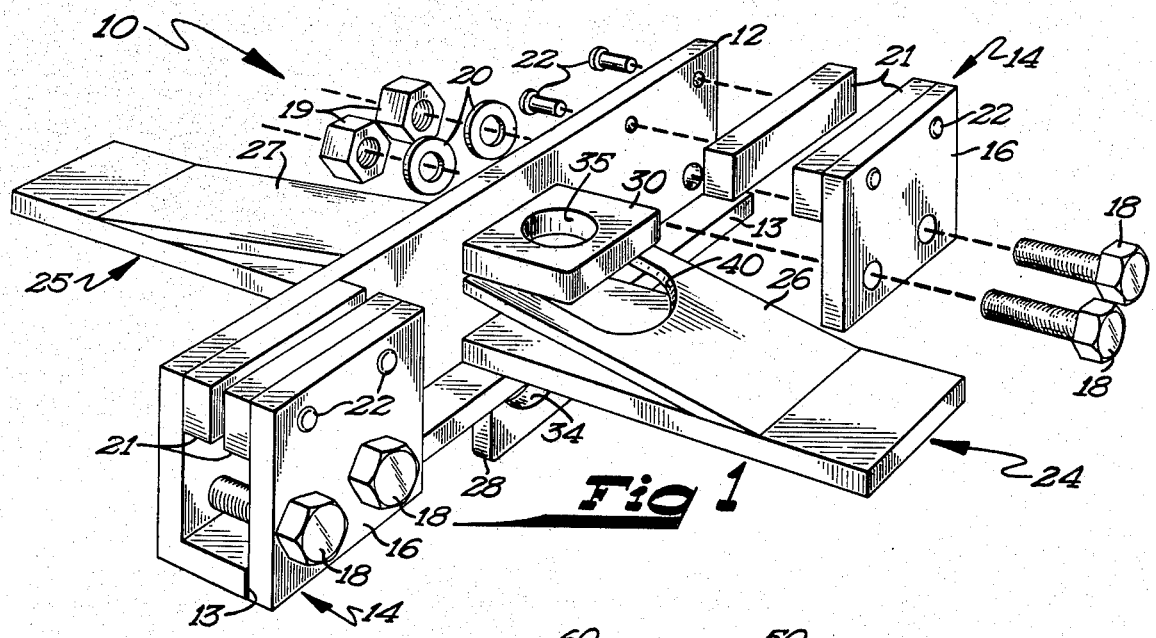
Fig 1
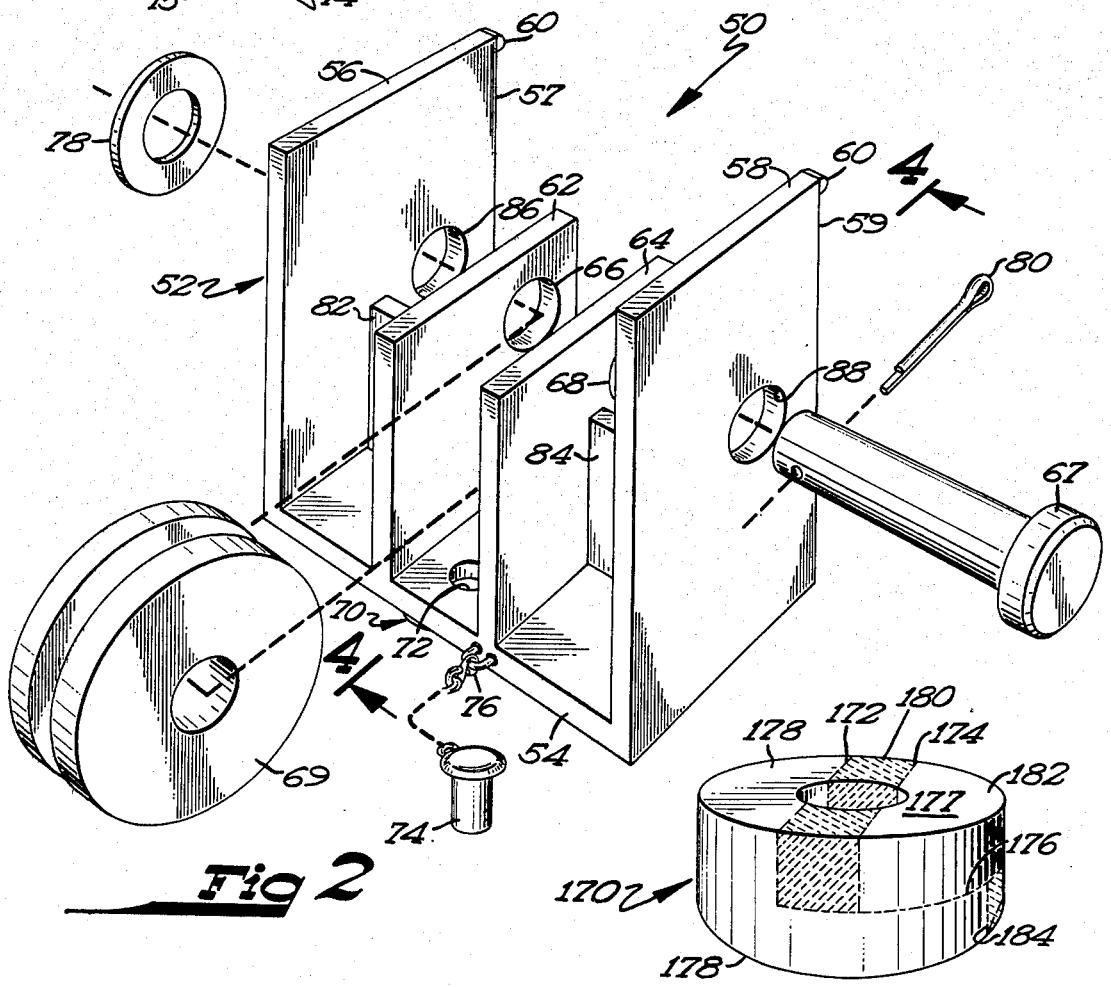
Fig 2
Fig 10

ACCESSORY FOR AN APPARATUS FOR REPAIRING AND STRAIGHTENING

CROSS REFERENCE

This is a division of application Ser. No. 722,825 filed Sept. 13, 1976, by the same inventor, now U.S. Pat. No. 4,138,877, which in turn is a continuation of application Ser. No. 550,378 filed Feb. 18, 1975, by the same inventor, now abandoned.

BACKGROUND

The present invention relates generally to an accessory, and more particularly, to an accessory for an apparatus for repairing and straightening vehicles.

With the increasing sophistication of apparatus for repairing and straightening, faster repairing and straightening of damaged vehicles has been attained without large expenditures of time, labor, and energy. There is also an increasing need for accessories for use in such apparatus for repairing and straightening to further increase their ability to repair vehicles have various types of damage and to further increase their efficiency to thus further reduce the time, labor, and effort required to repair and straighten vehicles. Also, such accessories should be easy to operate without the need for other type of apparatus.

Still further, such apparatus should be light in weight, and of small size thus allowing easy use thereof without the expenditures of large amounts of energy.

A special need has arisen for accessories for use in repairing unibody type vehicles. Previous apparatus used in anchoring unibody type vehicles had serious deficiencies in the ability to accept the counterforce conveyed from the vehicle substantially in line. Therefore, it was necessary to align the vehicle exactly in a position allowing the counterforce to be conveyed substantially in line. Thus, it was necessary to move the vehicle to an exact position, possibly several times, thus requiring large expenditures of time and effort. Also, if the vehicles were not substantially in line with the accessories, previously known accessories could damage the vehicle when the repair force was exerted thereto. Further, such previously known accessories also suffered serious deficiencies in the ability for their use in unibody vehicles having bent pinch welds.

SUMMARY

The present invention solves these and other problems in accessories for use in an apparatus for repairing and straightening by providing, in the preferred embodiment, a down pull member for directing a flexible pulling member to the vehicle including a member for attaching the down pull member to a support surface, for allowing rotational self-alignment of the down pull member, and for allowing the down pull member to be substantially in line with the counterforce of the flexible pulling member.

It is a primary object of the present invention to provide a novel accessory for use in an apparatus for repairing and straightening.

It is further an object of the present invention to provide such an accessory allowing self-alignment.

It is further an object of the present invention to provide such an accessory allowing the accessory to be substantially in line with the counterforce exerted by the vehicle.

It is further an object of the present invention to provide such accessories allowing a repair force to be exerted on the vehicle in a substantially vertical manner.

It is further an object of the present invention to provide such accessories which maximizes the materials used.

It is further an object of the present invention to provide such accessories which are easy to use in conjunction with an apparatus for repairing and straightening.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where:

FIG. 1 is an exploded perspective view of a clamp member utilizing the teachings of the present invention.

FIG. 2 is an exploded perspective view of a member which can be utilized with the apparatus of FIG. 1.

FIG. 10 is a perspective view showing the method of manufacture of the apparatus as best seen in FIGS. 4 and 5.

Figure 4:
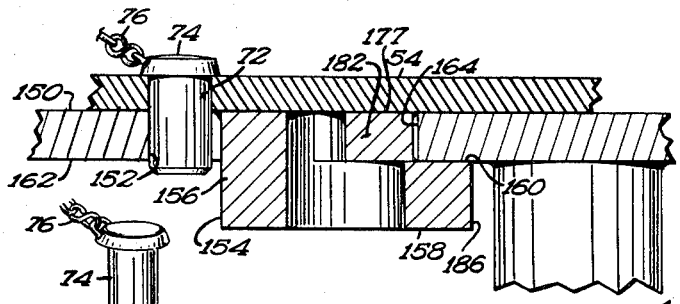
FIG. 4 is a cross sectional view of the apparatus of FIGS. 2 and 3 according to section line 4—4 of FIGS. 2 and 3.
Figure 5:
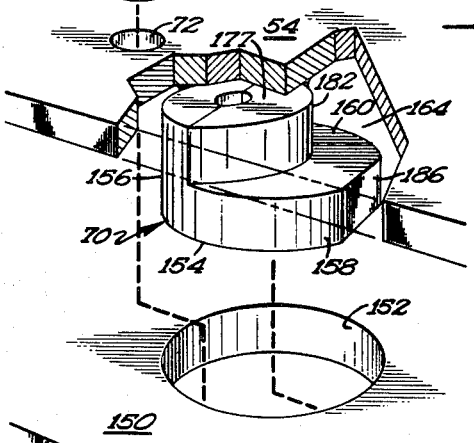
FIG. 5 is an exploded perspective view of the apparatus of FIG. 4 with portions of the apparatus broken away.
Figure 9:
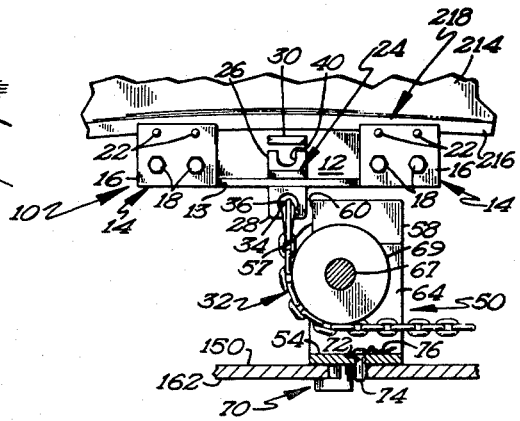
FIG. 9 is a side view of the apparatus of FIGS. 1 and 2 in use according to the teachings of the present invention.

The remaining figures of the drawings of the present invention and the remaining disclosure of the present invention, including preferred embodiments, are incorporated herein by reference to application Ser. No. 722,825 filed Sept. 13, 1976, by Gerald A. Specktor entitled "Accessories For An Apparatus For Repairing and Straightening", now U.S. Pat. No. 4,138,877, the parent application of the present application.

What is claimed is:

1. Accessory for an apparatus for repairing and straightening including a support surface for supporting a vehicle thereon comprising, in combination: a flexible pulling member including means at one end for attaching to the vehicle; down pull means for directing the flexible pulling member at an angle to the vehicle including substantially vertically of the vehicle; and means, for rotation about a vertical axis, for attaching the down pull means to the support surface vertically below the vehicle, for allowing rotational self-alignment of the down pull means about the vertical axis, and for allowing the down pull means to be substantially in line with the flexible pulling member when a repair force is applied to the other end of the flexible pulling member, wherein the down pull means comprises: a pulley, and means for removably, rotatably mounting the pulley, wherein the removably, rotatably mounting means comprises, in combination: a pin, and a first arm and a second arm upstanding from a center section, with the first and second arms having apertures formed therein for removably receiving the pin, and wherein the support surface has a top surface and a bottom surface defining a finite thickness and further includes at least one regularly shaped aperture passing vertically through the support surface and wherein the attaching, self-alignment, and allowing means comprises, in combination: attachment means having a cross sectional size substantially equal to but slightly less than the size of the aperture and having a removed portion of a thickness substantially equal to but slightly greater than the thickness of the support surface for allowing the attachment means to be vertically inserted into the support surface aperture and moved in a first lateral direction parallel to the support surface to engage the support surface within the removed portion, with a lip being defined by the removed portion for abutting with the bottom surface of the support surface; means for preventing the attachment means from moving in a second lateral direction opposite to the first lateral direction and for preventing unintentional removal of the attachment means from the aperture; and means extending around the preventing means, located on the opposite side of the attachment means from the lip, for abutting with the top surface of the support surface.

2. The accessory of claim 1 wherein the center section of the down pull means extends beyond the attachment means adjacent to the preventing means for abutting with the top surface of the support surface and comprises the top surface abutting means.

3. Accessory for an apparatus for repairing and straightening including a support surface for supporting a vehicle thereon comprising, in combination: a flexible pulling member including means at one end for attaching to the vehicle; down pull means for directing the flexible pulling member at an angle to the vehicle including substantially vertically of the vehicle; and means, for rotation about a vertical axis, for attaching the down pull means to the support surface vertically below the vehicle, for allowing rotational self-alignment of the down pull means about the vertical axis, and for allowing the down pull means to be substantially in line with the flexible pulling member when a repair force is applied to the other end of the flexible pulling member, wherein the support surface has a top surface and a bottom surface defining a finite thickness and further includes at least one regularly shaped aperture passing vertically through the support surface and wherein the attaching, self-alignment, and allowing means comprises, in combination: attachment means having a cross sectional size substantially equal to but slightly less than the size of the aperture and having a removed portion of a thickness substantially equal to but slightly greater than the thickness of the support surface for allowing the attachment means to be vertically inserted into the support surface aperture and moved in a first lateral direction parallel to the support surface to engage the support surface within the removed portion, with a lip being defined by the removed portion for abutting with the bottom surface of the support surface; means for preventing the attachment means from moving in a second lateral direction opposite to the first lateral direction and for preventing unintentional removal of the attachment means from the aperture; and means extending around the preventing means, located on the opposite side of the attachment means from the lip, for abutting with the top surface of the support surface.

4. The accessory of claim 3 wherein the down pull means includes the top surface abutting means which comprises, in combination: a flat, bottom section, with the bottom section of the down pull means extending beyond the attachment means adjacent to the preventing means for abutting with the top surface of the support surface.

5. The accessory of claim 4 wherein the attachment means comprises a cylindrical member formed of thick wall tubing having a notch formed therein by a first saw cut of a depth substantially equal to but slightly greater than the thickness of the support surface and along a cord of the circular cross section, a second saw cut spaced from and parallel to the first saw cut and of a depth equal to the depth of the first saw cut, a third saw cut perpendicular to the first and second saw cuts and intersecting therewith, with the material located between the first and second saw cuts being removed and the remaining portions being attached together, and with the cylindrical member being attached to the bottom surface of the down pull means.

6. The accessory of claim 1 or 3 wherein the support surface aperture is circular in shape and wherein the attachment means has a circular cross section.

7. The accessory of claim 1 or 3 wherein the preventing means comprises a pin inserted within the support surface aperture next to the attachment means after the attachment means has been moved in the first lateral direction to an extent that the support surface engages the removed portion.

8. The accessory of claim 1 or 3 wherein the attachment means includes an L-shaped member including a vertical leg and a horizontal leg, with the horizontal leg defining the abutting lip, wherein the vertical leg is attached to the bottom surface of the down pull means, and wherein the removed portion is defined between the horizontal leg and the bottom surface of the down pull means.

9. The accessory of claim 1 or 3 wherein the lip of the attachment means includes a flat end portion for transferring the counterforce from the attachment means to the bottom surface of the support surface along a line and for reducing the shearing effect of the lip on the support surface.

10. The accessory of claim 1 or 3 wherein the attachment means comprises a cylindrical member formed of thick wall tubing having a notch formed therein by a first saw cut of a depth substantially equal to but slightly greater than the thickness of the support surface and along a cord of the circular cross section, a second saw cut spaced from and parallel to the first saw cut and of a depth equal to the depth of the first saw cut, a third saw cut perpendicular to the first and second saw cuts and intersecting therewith, with the material located between the first and second saw cuts being removed and the remaining portions being attached together, and with the cylindrical member being attached to the bottom surface of the down pull means.

* * * * *